US007257954B2

(12) United States Patent
Ushio et al.

(10) Patent No.: US 7,257,954 B2
(45) Date of Patent: Aug. 21, 2007

(54) FUNCTION SWITCHING METHOD, FUNCTION SWITCHING APPARATUS, DATA STORAGE METHOD, DATA STORAGE APPARATUS, DEVICE, AND AIR CONDITIONER

(75) Inventors: Toshinori Ushio, Osaka (JP); Keiichi Yoshisaka, Osaka (JP); Mitsuhiko Yamamoto, Osaka (JP); Masaaki Yokoi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 337 days.

(21) Appl. No.: 10/489,178

(22) PCT Filed: Sep. 24, 2002

(86) PCT No.: PCT/JP02/09785

§ 371 (c)(1),
(2), (4) Date: Mar. 10, 2004

(87) PCT Pub. No.: WO03/027579

PCT Pub. Date: Apr. 3, 2003

(65) Prior Publication Data

US 2004/0233766 A1 Nov. 25, 2004

(30) Foreign Application Priority Data

Sep. 25, 2001 (JP) ..... 2001-291665
Sep. 25, 2001 (JP) ..... 2001-291667

(51) Int. Cl.
*G05D 23/32* (2006.01)
*H04M 11/00* (2006.01)

(52) U.S. Cl. ..... 62/157; 379/88.19

(58) Field of Classification Search ..... 62/157, 62/158; 379/88.19; 73/800; 250/221
See application file for complete search history.

(56) References Cited

U.S. PATENT DOCUMENTS 5,162,793 A * 11/1992 Plost et al. ..... 340/984

FOREIGN PATENT DOCUMENTS

JP 61-10475 U 1/1986
JP 2-118711 A 5/1990

(Continued)

*Primary Examiner*—Chen Wen Jiang
(74) *Attorney, Agent, or Firm*—Birch, Stewart, Kolasch & Birch, LLP

(57) ABSTRACT

An object of the present invention is to provide a technique capable of assembling a device in both of a first device performing a first function with a predetermined part and a second device performing a second function without a second part, and instructing each of the first and second functions. Determining means (92) determines the presence or absence of an electronic expansion valve (91) and gives the result to a central processing unit (93). The central processing unit (93) allows a gate array (94) operate and instruct a first function including a function of performing communication between a communication network (83) and an indoor unit (92*a*). When there is no electronic expansion valve (EV), the determining means (92) sends a result of the determination result indicative of the absence to the central processing unit (93). The central processing unit (93) instructs a second function of making the gate array (94) inoperative.

7 Claims, 9 Drawing Sheets

FOREIGN PATENT DOCUMENTS

| | | | |
|---|---|---|---|
| JP | 02-267482 | A | 11/1990 |
| JP | 5-172390 | A | 7/1993 |
| JP | 8-161250 | A | 6/1996 |
| JP | 9-265391 | A | 10/1997 |
| JP | 10-171744 | A | 6/1998 |
| JP | 10-198627 | A | 7/1998 |
| JP | 11-201532 | A | 7/1999 |
| JP | 11-306129 | A | 11/2006 |

* cited by examiner

FUNCTION SWITCHING METHOD, FUNCTION SWITCHING APPARATUS, DATA STORAGE METHOD, DATA STORAGE APPARATUS, DEVICE, AND AIR CONDITIONER

TECHNICAL FIELD

The present invention relates to a technique of performing different operations according to the presence absence of a part. For example, the present invention relates to a control technique which can be commonly employed for a plurality of different devices and a technique of alternatively storing two pieces of different data to a rewritable ROM.

BACKGROUND ART

For example, there are air conditioning systems of a first type in which an air conditioner is remote-monitored and remote-controlled by communication from a central control unit and of a second type in which an air conditioner operates singly. The air conditioners are of a first type which has a predetermined part, for example, an electronic expansion valve of an indoor unit and of a second type which does not have an electronic expansion valve.

For example, the air conditioning system of the first type employs the air conditioner of the first type, and the air conditioning system of the second type employs the air conditioner of the second type.

The air conditioner of the first type requires a communication function for performing communication with the outside for the purpose of performing communication with a central control unit. On the other hand, the air conditioner of the second type does not require the communication function since communication with the outside is unnecessary.

In a conventional air conditioner, two controllers one of which has the communication function and the other of which has no communication function according to the first and second types have to be designed and manufactured. Generally, however, in order to reduce the cost by mass production, increase in price due to designing and manufacturing of a plurality of kinds of products exerts a larger influence on price than increase in price caused by addition of a function.

FIGS. 13 and 14 are block diagrams showing a conventional technique and illustrate the configurations of air conditioners of the second type and the first type, respectively. An air conditioner 100*a* shown in FIG. 13 includes an electronic circuit 21 customarily called a P board and a driving system 30*a* for performing compression of a refrigerant, heat exchange and the like. An air conditioner 100*b* shown in FIG. 14 includes the electronic circuit 21 and a driving system 30*b*. The driving system 30*b* includes, different from the driving system 30*a*, an electronic expansion valve EV.

The electronic circuit 21 has a control unit 5 and an integrated circuit 11 for giving an instruction to the control unit 5. In order to control each of the driving system 30*a* without electronic expansion valve EV and the driving system 30*b* with the electronic expansion valve EV, the control unit 5 and the integrated circuit 11 having the same configuration are used. Specifically, the control unit 5 directly controls each of the driving systems 30*a* and 30*b*, and the integrated circuit 11 indirectly controls each of the driving systems 30*a* and 30*b*.

Generally, in a technique of controlling the operation of an equipment by a microcomputer, a CPU (Central Processing Unit) performs the control on the basis of predetermined data (including a program in the specification). The data is written in a ROM (Read Only Memory) and the CPU controls the operation of the equipment by using necessary data in the ROM. However, even when the kinds of models to be controlled are different from each other, an agent of the control can be easily designed and manufactured by employing the same configuration for the agent of the control.

The integrated circuit 11 has a rewritable EEPROM (Electrically Erasable Programmable ROM) 2 and a CPU 3. The CPU 3 gives the above instruction to the control unit 5. The instruction to the air conditioner 100*a* and the instruction to the air conditioner 100*b* are naturally different from each other depending on the presence/absence of the electronic expansion valve EV. Therefore, the initial value of data (referred to as "initial data" in the specification) based on which the CPU 3 operates in the case where the electronic circuit 21 is mounted on the air conditioner 100*a* and that in the case where the electronic circuit 21 is mounted on the air conditioner 100*b* are different from each other.

However, by properly selecting two different pieces of data to be stored as the initial data into the EEPROM 2 to store the selected data in the EEPROM 2 in accordance with the case where the electronic circuit 21 is mounted on the air conditioner 100*a* and the case where the electronic circuit 21 is mounted on the air conditioner 100*b*, the same configuration can be used for the electronic circuit 21 in both of the cases.

It is desirable to store the data based on which the CPU 3 operates in not the ROM but the EEPROM 2 also from the viewpoint of storing settings desired by the user as the air conditioners 100*a* and 100*b* are used.

In the conventional technique, however, which one of the air conditioners 100*a* and 100*b* is used is determined by a person and initial data of the EEPROM 2 is written accordingly from an external equipment by communication. It requires much efforts at the time of initial setting of the electronic circuit 21 or the air conditioners 100*a* and 100*b* each having the electronic circuit 21.

It is difficult to use the electronic circuit 21 which is once assembled in the air conditioner 100*a* or 100*b* and includes the EEPROM 2 into which initial data EEA or EEB is written as a patch part for the other air conditioner 100*b* or 100*a*.

DISCLOSURE OF THE INVENTION

The present invention has been achieved in consideration of the above circumstances and it is an object thereof to provide a technique capable of assembling a device in both of a first device performing a first function with a predetermined part and a second device performing a second function without a second part, and instructing each of the first and second functions, or a technique capable of assembling a device in both of a first device performing a first function without a predetermined part and a second device performing a second function with a second part, and instructing each of the first and second functions. It is another object of the present invention to provide a technique of automatically selecting first and second data and storing the selected data into a rewritable ROM.

In a first aspect of a function switching method in the present invention, a device is controlled in which a first function which requires an operation of a first part (94) and a second function which does not require the operation of the first part are switched depending on presence/absence of a second part (EV). The method comprises steps of (a) (S91) determining the presence/absence of the second part, and (b) (S92 to S95) determining whether the operation of the first part can be performed or not on the basis of the result of the step (a).

According to the first aspect of the function switching method in the present invention, even in a device in which the first part is assembled, the first part can be made inoperative in accordance with the presence/absence of the second part. Consequently, two kinds of devices one of which has the first part and the other of which has no first part are not manufactured according to the presence/absence of the second part. However, it is sufficient to manufacture one kind of a device always including the first part. It results in reduction of designing and manufacturing cost.

According to a second mode of the function switching method in the present invention, in the first mode of the function switching method, the first part (94) operates on the basis of a clock.

According to the second mode of the function switching method in the present invention, by making the first part inoperative in accordance with the presence/absence of the second part, generation of unnecessary clock noise can be avoided in the second function.

A first mode of a function switching device (90, 95) in the present invention has a processor (93) and a first part (94). The processor determines whether an operation of the first part can be performed or not depending on presence/absence of a second part (EV) on the outside of the function switching device, thereby instructing the outside of the function switching device to be switched between a first function which requires an operation of the first part and a second function which does not require the operation of the first part. Desirably, the function switching device further comprises determining means (12) for determining the presence/absence of the second part and transmitting a result thereof to the processor (10).

According to the first mode of the function switching device in the present invention, the device can be assembled in both of a first device performing a first function with a second part and a second device performing a second function without a second part, and can instruct each of the first and second functions. That is, the device can be used for both of the first and second devices. Thus, design and manufacturing costs of the switching device can be reduced. This can be applied to the case where the first device performs the first function without the second part and the second device performs the second function with the second part.

A second aspect (90, 95) of the function switching device in the present invention is the first mode of the function switching device and the first part (94) operates on the basis of a clock. For example, the first part (94) has a communicating function. The function switching device is included in, for example, an air conditioner (92*a*, 92*b*).

According to the second aspect of the function switching device in the present invention, by making the first part inoperative in accordance with the presence/absence of the second part, generation of unnecessary clock noise can be avoided in the second function.

A first aspect of the data storing method in the present invention is a method of storing data which controls an operation of an equipment (100*c*, 100*d*) into a rewritable ROM (2). The method comprises steps of (a) (S5) determining whether a predetermined part (EV) exists in the equipment or not, and (b) (S6, S7) alternatively storing first and second data (EEA and EEB) from a ROM (1) for storing the first and second data into the rewritable ROM on the basis of a result of determination in the step (a).

According to the first aspect of the data storing method of the present invention, depending on whether a predetermined part exists or not, the first and second data is alternatively stored into the rewritable ROM. Consequently, in correspondence with the model which varies according to whether the predetermined part exits or not, data can be automatically set in the rewritable ROM.

A second aspect of the data storing method in the present invention further comprises, in the first aspect of the data storing method, before the step (a), steps of (c) (S1) determining whether the rewritable ROM (2) can be formattable or not; (d) (S2) setting an automatic mode of automatically determining a model of the equipment in the case where the rewritable ROM can be formattable; and (e) (S4) determining whether the automatic mode has been set after the step (c) or not. The step (a) and the step (b) are executed in a case where the automatic mode is set.

According to the second aspect of the data storing method in the present invention, when the rewritable ROM can be formattable, the automatic mode can be set so that the steps (a) and (b) can be executed.

In a third aspect of the data storing method in the present invention, in the second aspect of the data storing method, the step (d) has a step (S2) of storing common data (COM), which is stored into the rewritable ROM commonly in both of the case where the predetermined part exists in the equipment and the case where the predetermined part does not exist in the equipment, from the ROM into the rewritable ROM.

According to the third aspect of the data storing method in the present invention, by setting the common data which is commonly used for both of the model which has a predetermined part and a model which does not have the predetermined part, the amount of data stored in the ROM can be reduced.

In a fourth aspect of the data storing method in the present invention, in the third aspect of the data storing method, the common data includes determination mode data (D) indicative of a mode of determining a model of the equipment. In the step (e), the determination is made on the basis of whether the determination mode data indicates the automatic mode or not.

According to the fourth aspect of the data storing method in the present invention, the automatic mode of automatically determining the model of an equipment can be easily set.

In a fifth aspect of the data storing method in the present invention, in the third mode of the data storing method, the determination is made on the basis of presence/absence of the common data (COM) in the step (c).

According to the fifth aspect of the data storing method in the present invention, common data is written in a step (d-1), so that the rewritable ROM has been once subjected to the data storing method or not can be determined.

In a sixth aspect of the data storing method in the present invention, in the second aspect of the data storing method, the step (d) has a step (S3) of storing the first data from the ROM into the rewritable ROM.

According to the sixth aspect of the data storing method of the present invention, data to be stored in the rewritable ROM is tentatively determined.

In a seventh aspect of the data storing method in the present invention, in any of the first to sixth aspects of the data storing method, the method further comprises, after the step (b), a step (S9, S10, S11 and S12) of (f) alternatively storing the first and second data into the rewritable ROM irrespective of the result of the determination in the step (a).

According to the seventh aspect of the data storing method in the present invention, data in the rewritable ROM which is automatically set can be manually reset. Thus, the present invention can flexibly deal with a change at a site in which the equipment is installed.

A first aspect of a data storing device (10, 20) in the present invention comprises: a ROM (1) for storing first and second data (EEA and EEB) for controlling operations of equipments (100*c*, 100*d*) of different kinds respectively; a rewritable ROM (2) into which the first and second data is alternatively stored from the ROM in accordance with the kind of the equipment; and a processor (3) for controlling the operation of the equipment on the basis of data stored in the rewritable ROM. Desirably, the device further comprises a determining unit (4) for determining whether a predetermined part (EV) exists in the equipment or not and giving a result of the determination to the processor. The processor alternatively stores the first and second data from the ROM into the rewritable ROM on the basis of the result of the determination.

According to a first aspect of the data storing device in the present invention, the first and second data is alternatively stored into the rewritable ROM, so that the data of the rewritable ROM can be automatically set in correspondence with the model which varies according to whether the predetermined part exists or not.

In a second aspect of the data storing device (20) in the present invention, in the first aspect of the data storing device, common data (COM), which is stored in the rewritable ROM commonly in both of the case where the predetermined part exists in the equipment and the case where the predetermined part does not exist in the equipment, is stored in the ROM (1).

In the second aspect of the data storing device in the present invention, by setting common data, which is commonly used for the model which includes the predetermined part and the model which does not include the predetermined part, the amount of data stored in the ROM can be reduced.

An equipment (100*c*, 100*d*) according to the present invention comprises a driving system (30*a*, 30*b*) and a data storing device (10). The data storing device (10) has a ROM (1) for storing first and second data (EEA, EEB) for controlling an operation of the driving system, a rewritable ROM (2) into which the first and second data is alternatively stored from the ROM in accordance with the kind of the equipment, and a processor (3) for controlling the operation of the equipment on the basis of data stored in the rewritable ROM. Desirably, the equipment further comprises a determining unit (4) for determining whether a predetermined part (EV) exists in the equipment or not and giving the result of the determination to the processor. The processor alternatively stores the first and second data from the ROM into the rewritable ROM on the basis of the result of the determination. For example, the equipment functions as an air conditioner having an electronic expansion valve as the predetermined part.

In the equipment according to the present invention, the first and second data is alternatively stored into the rewritable ROM, so that the data of the rewritable ROM can be automatically set in correspondence with the model which varies according to whether the predetermined part exists or not.

These and other objects, features, aspects and advantages of the present invention will become more apparent from the following detailed description of the present invention when taken in conjunction with the accompanying drawings.

BEST MODE FOR CARRYING OUT THE INVENTION

First Embodiment

Figure 1:
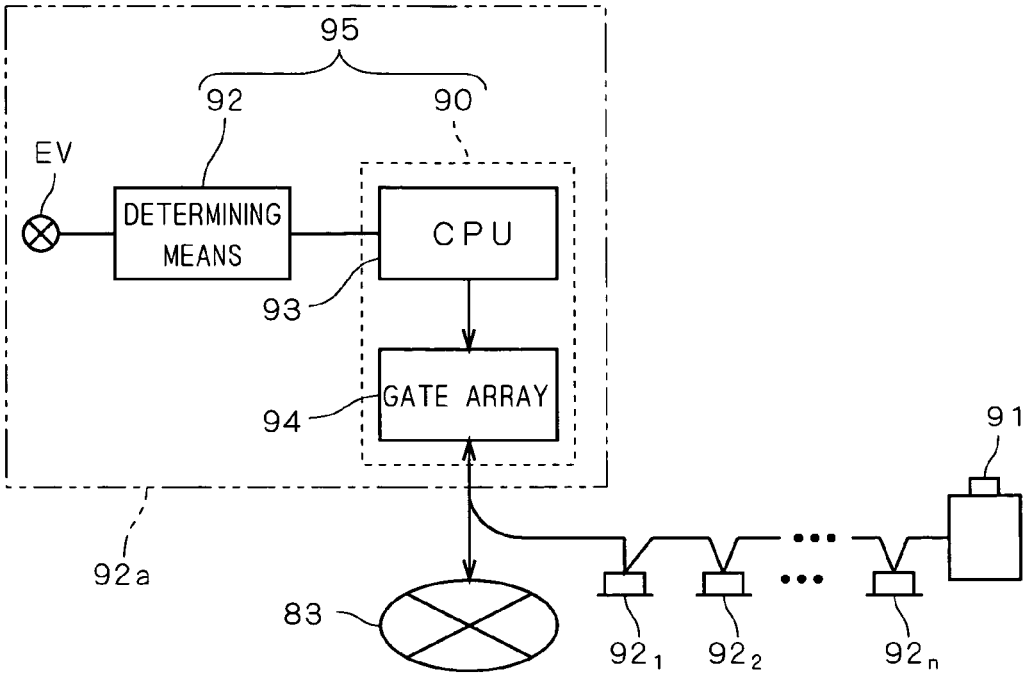
FIG. 1 is a block diagram showing a first embodiment of the present invention.

FIG. 1 is a block diagram showing an embodiment of the present invention. As air conditioners, an outdoor unit 91 and indoor units 92*a*, $\mathbf{92}_1$, $\mathbf{92}_2$, . . . and $\mathbf{92}_n$ are provided.

The indoor unit 92*a* includes an integrated circuit 90 functioning as a controller. The integrated circuit 90 has a CPU 93 for performing various processes and a gate array 94 as a part performing a communicating function. The indoor unit 92*a* is connected to the outdoor unit 91, indoor units $\mathbf{92}_1$, $\mathbf{92}_2$, . . . and $\mathbf{92}_n$ and a communication network 83 by the gate array 94. That is, the air conditioner shown in FIG. 1 is used in an air conditioning system of the first type described in the conventional technique.

The indoor unit 92*a* further has a determining unit 92 and an electronic expansion valve EV. The electronic expansion valve EV is provided in a not-shown refrigerant system and performs a known function. That is, the air conditioner shown in FIG. 1 is the air conditioner of the first type described in the conventional technique. The determining means 92 determines the presence or absence of the electronic expansion valve EV and the result (that is, the presence of the electronic expansion valve EV) is given to the CPU 93. The determining means 92 can be grasped as an electronic circuit 95 together with the integrated circuit 90. Each of the indoor units $\mathbf{92}_1$, $\mathbf{92}_2$, . . . , and $\mathbf{92}_n$ can also employ the same configuration as that of the indoor unit 92*a*.

Figure 2:
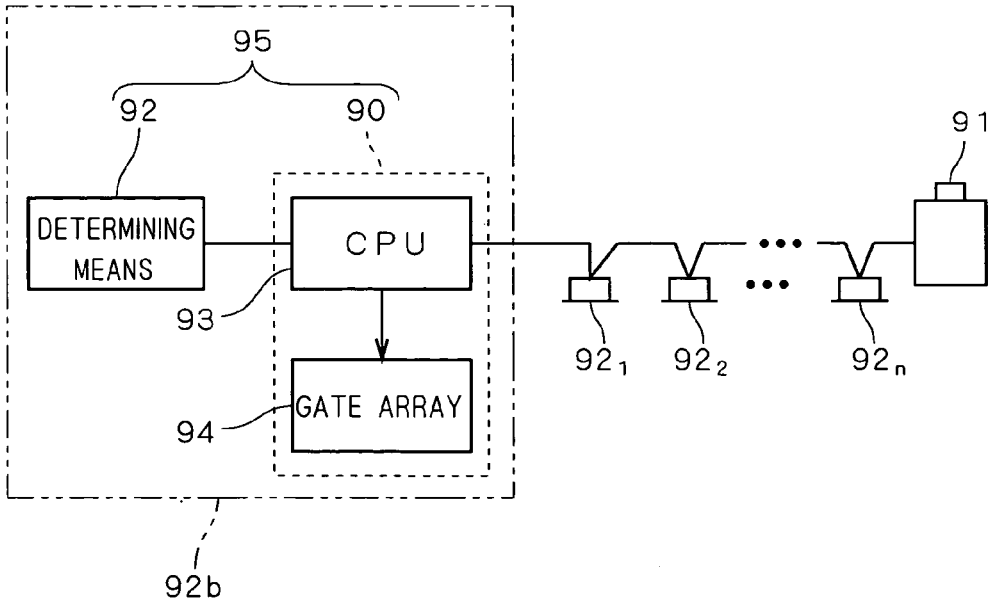
FIG. 2 is a block diagram showing the first embodiment of the present invention.

FIG. 2 is a block diagram also showing an embodiment of the present invention. As air conditioners, the outdoor unit 91 and indoor units 92*b*, $\mathbf{92}_1$, $\mathbf{92}_2$, . . . and $\mathbf{92}_n$ are provided.

The indoor unit 92*b* also has, like the indoor unit 92*a*, the integrated circuit 90 and the determining means 92. However, different from the indoor unit 92*a*, the indoor unit 92*b* does not have the electronic expansion valve EV and is not connected to the communication network 83. That is, the air conditioner shown in FIG. 2 is the air conditioner of the second type described in the conventional technique and used in the air conditioning system of the second type. The indoor units $\mathbf{92}_1$, $\mathbf{92}_2$, . . . and $\mathbf{92}_n$ can employ the same configuration as that of the indoor unit 92*b* and are connected to each other by their CPUs 93 and also connected to the outdoor unit 91 by their CPUs 93.

In the indoor unit 92*b*, the determining means 92 determines that the electronic expansion valve EV does not exist and the result (that is, the presence of the electronic expansion valve EV) is given to the CPU 93.

Since the gate array 94 is a part performing the communicating function, it operates based on clocks. However, since the indoor unit 92*b* is used in the air conditioning system of the second type, the operation of the gate array 94 for connection to the communication network 83 is unnecessary. On the contrary, there is the possibility that clock noise is outputted from the gate array 94 and that unnecessary noise is caused in the air conditioning system of the second type.

In the embodiment, however, in the indoor unit 92*a*, a first function having both the communicating function performed by the gate array 94 and the normal control function which is necessary for both of the air conditioners of the first and second types is performed. An instruction of the first function is given by the integrated circuit 90. On the other hand, the indoor unit 92*b* does not have the communicating function performed by the gate array 94, and a second function having the normal control function is performed. An instruction of the second function is given by the integrated circuit 90.

Figure 3:
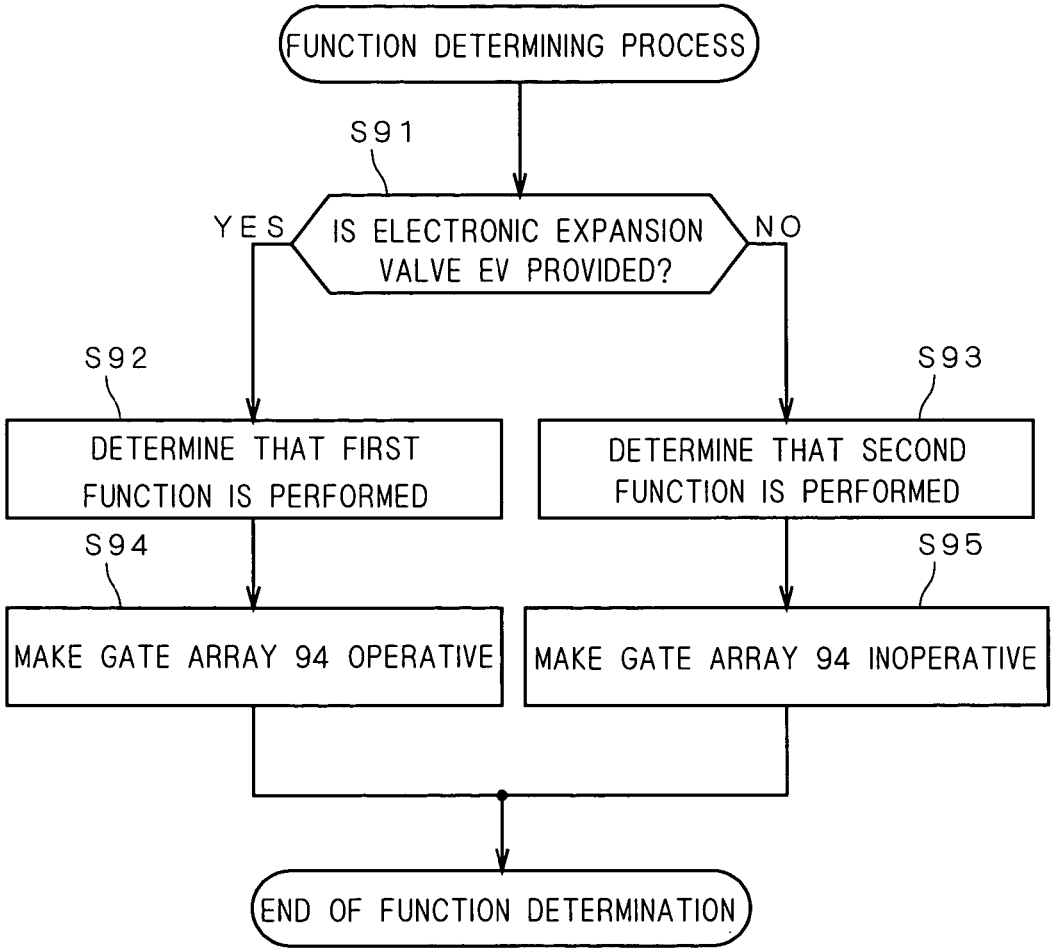
FIG. 3 is a flowchart showing the first embodiment of the present invention.

FIG. 3 is a flowchart showing a process of determining the first and second functions in the electronic circuit 95. First, in step S91, the presence/absence of the electronic expansion valve EV is determined by the determining means 92. The determining means 92 and its operation are known and introduced by, for example, Japanese Patent Application Laid-Open No. 2-267482.

When the presence of the electronic expansion valve EV is determined, the route indicated as "YES" in the diagram leading to step S92 is adopted. This is the case where the air conditioner of the first type shown in FIG. 1 is provided with the electronic circuit 95. In step S92, it is determined by the CPU 93 that the air conditioner on which the electronic circuit 95 or the integrated circuit 90 is mounted is of the first type and performs the first function. Proceeding to step S94, the CPU 93 makes the gate array 94 operate.

On the other hand, when the absence of the electronic expansion valve EV is determined, the route indicated as "NO" in the diagram leading to step S93 is adopted. This is the case where the air conditioner of the second type shown in FIG. 2 is provided with the electronic circuit 95. In step S93, it is determined by the CPU 93 that the air conditioner on which the electronic circuit 95 or the integrated circuit 90 is mounted is of the second type and performs the second function. Proceeding to step S95, the CPU 93 does not make the gate array 94 operate. Concretely, for example, a reset signal is supplied from the CPU 93 to the gate array 94.

In such a manner, the first function which needs the operation of the gate array 94 and the second function which does not need the operation of the gate array 94 are switched depending on the presence or absence of the electronic expansion valve EV. On the basis of the presence or absence of the electronic expansion valve EV, whether the gate array 94 can operate or not is determined. Consequently, according to the absence of the electronic expansion valve EV, the gate array 94 is not operated in the integrated circuit 90, electronic circuit 95 or, further, the indoor unit 92*b* in which the gate array 94 is assembled. Therefore, two kinds of the integrated circuits 90 and the electronic circuits 95 respect to having the gate array 94 or not are not manufactured according to the indoor units 92*a* and 2*b* which are different from each other with respect to the presence/absence of the electronic expansion valve EV. However, it is sufficient to manufacture one kind of the integrated circuit 90 and one kind of the electronic circuit 95 always including the gate array 94 by a manufacturing apparatus. It results in reduction of designing and manufacturing cost.

Particularly, since the gate array 94 operates on the basis of clocks, in the air conditioner of the second type and in the air conditioning system of the second type, generation of unnecessary clock noise can be avoided.

In the above description, the air conditioner of the first type having the electronic expansion valve EV and performing the first function and the air conditioner of the second type having no electronic expansion valve EV and displaying the second function were described as an example. However, obviously, an object of which presence or absence is to be determined is not limited to the electronic expansion valve EV. The present invention can be also generally applied to a case where the object is a predetermined part. The present invention can be also applied to a device of the first type having no predetermined part and performing the first function and a device of the second type having the predetermined part and performing the second function.

Second Embodiment

Figure 4:
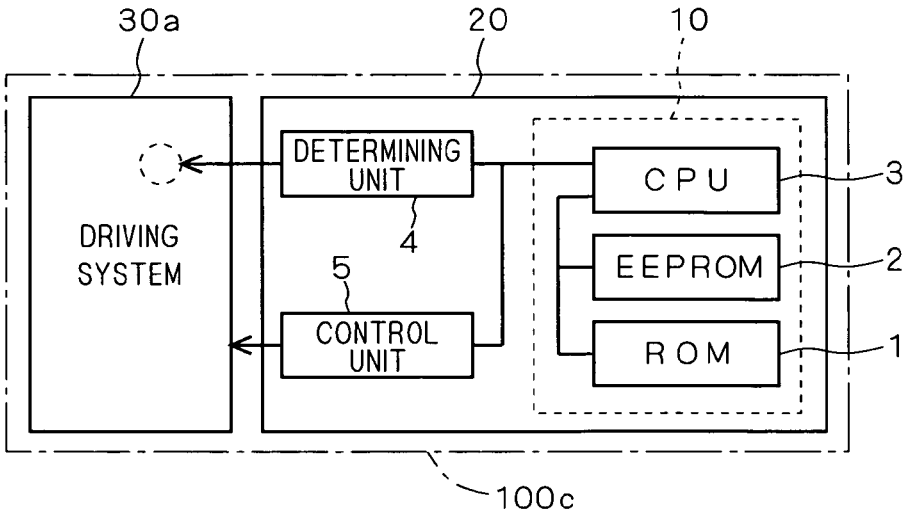
FIG. 4 is a block diagram showing a second embodiment of the present invention.
Figure 5:
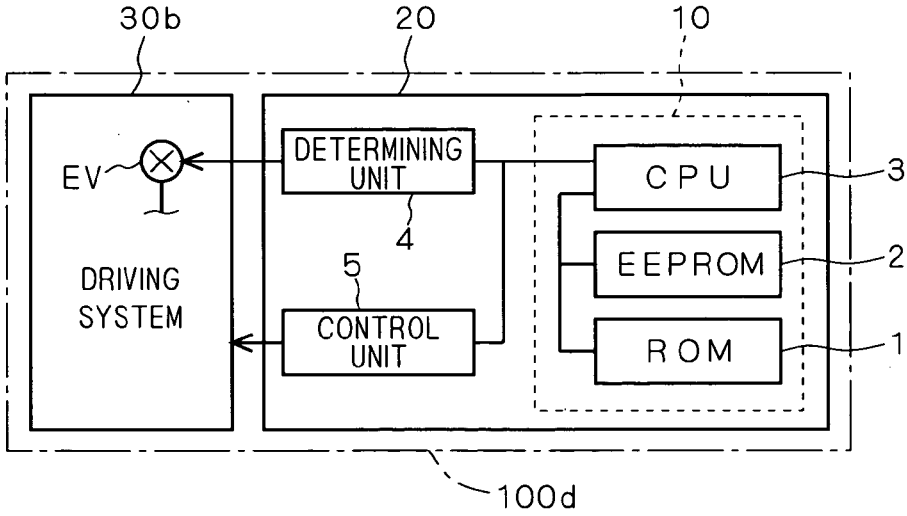
FIG. 5 is a block diagram showing the second embodiment of the present invention.
Figure 13:
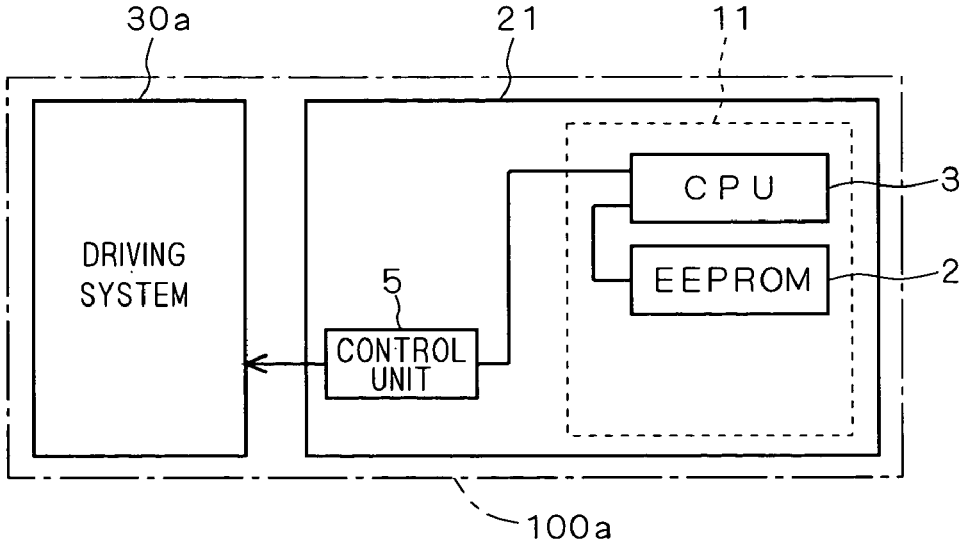
FIG. 13 is a block diagram showing a conventional technique.
Figure 14:
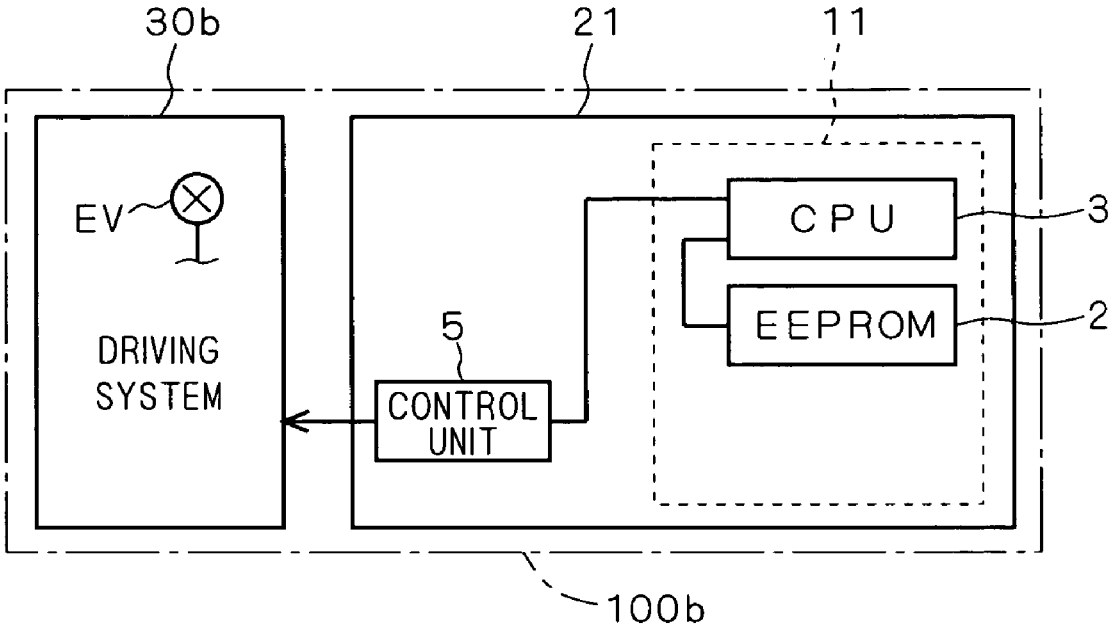
FIG. 14 is a block diagram showing a conventional technique.

FIGS. 4 and 5 are block diagrams each showing an air conditioner as an embodiment of the present invention. An air conditioner 100*c* shown in FIG. 4 is an air conditioner of the second type and includes an electronic circuit 20 as a P board, and the driving system 30*a* which was described with respect to the air conditioner 100*a* in FIG. 13. The electronic circuit 20 has a determining unit 4, integrated circuit 10, and control unit 5 which was described with respect to the air conditioner 100*a* in FIG. 13. In FIG. 4, a broken line indicates that the driving system 30*a* does not have the electronic expansion valve EV. On the other hand, an air conditioner 100*d* shown in FIG. 5 is an air conditioner of the first type and has the electronic circuit 20 and the driving system 30*b* which was described with respect to the air conditioner 100*b* of FIG. 14.

The integrated circuit 10 has a ROM 1, the EEPROM 2, and the CPU 3. The CPU 3 gives an instruction to the control unit 5. The operation of the CPU 3 and the control unit 5 is based on data stored in the EEPROM 2.

The ROM 1 stores: common data COM necessary for the operation of the CPU 3 commonly in the case where the electronic circuit 20 is mounted on the air conditioner 100*c* and the case where the electronic circuit 20 is mounted on the air conditioner 100*d*; initial data EEA which is necessary when the electronic circuit 20 is mounted on the air conditioner 100*c* and is not necessary in the case where the electronic circuit 20 is mounted on the air conditioner 100*d*;

and initial data EEB which is not necessary in the case where the electronic circuit 21 is mounted on the air conditioner 100*c* but is necessary in the case where the electronic circuit 21 is mounted on the air conditioner 100*d*.

The determining unit 4 determines whether or not the electronic expansion valve EV exists in the driving system of the air conditioner on which the electronic circuit 20 is mounted and gives the result of determination to the CPU 3. Therefore, the determining unit 4 notifies the CPU 3 of the absence of the electronic expansion valve EV in the case where the electronic circuit 20 in which the determining unit 4 itself is provided is mounted on the air conditioner 100*c* or the presence of the electronic expansion valve EV in the case where the electronic circuit 20 is mounted on the air conditioner 100*d*. Based on the notification, the CPU 3 selects one of the two different pieces of data and stores the selected data from the ROM 1 to the EEPROM 2.

In the embodiment as described above, the initial data EEA and EEB is preliminarily stored in the ROM 1 and, on the basis of a result of determination of the type of the equipment, the electronic circuit 20 can automatically and alternatively the initial data EEA and EEB from the ROM 1 to the EEPROM 2. The control unit 5 receives an instruction from the CPU 3 operating on the basis of data stored in the EEPROM 2, and controls the operations of the driving system 30*a* or 30*b*. Therefore, even when there are a plurality of kinds of equipments, one kind of the configuration of the electronic circuit 20 can be designed and manufactured. To determine the kind of the equipment, for example, a result of determination of the presence/absence of the electronic expansion valve EV is used.

Figure 6:
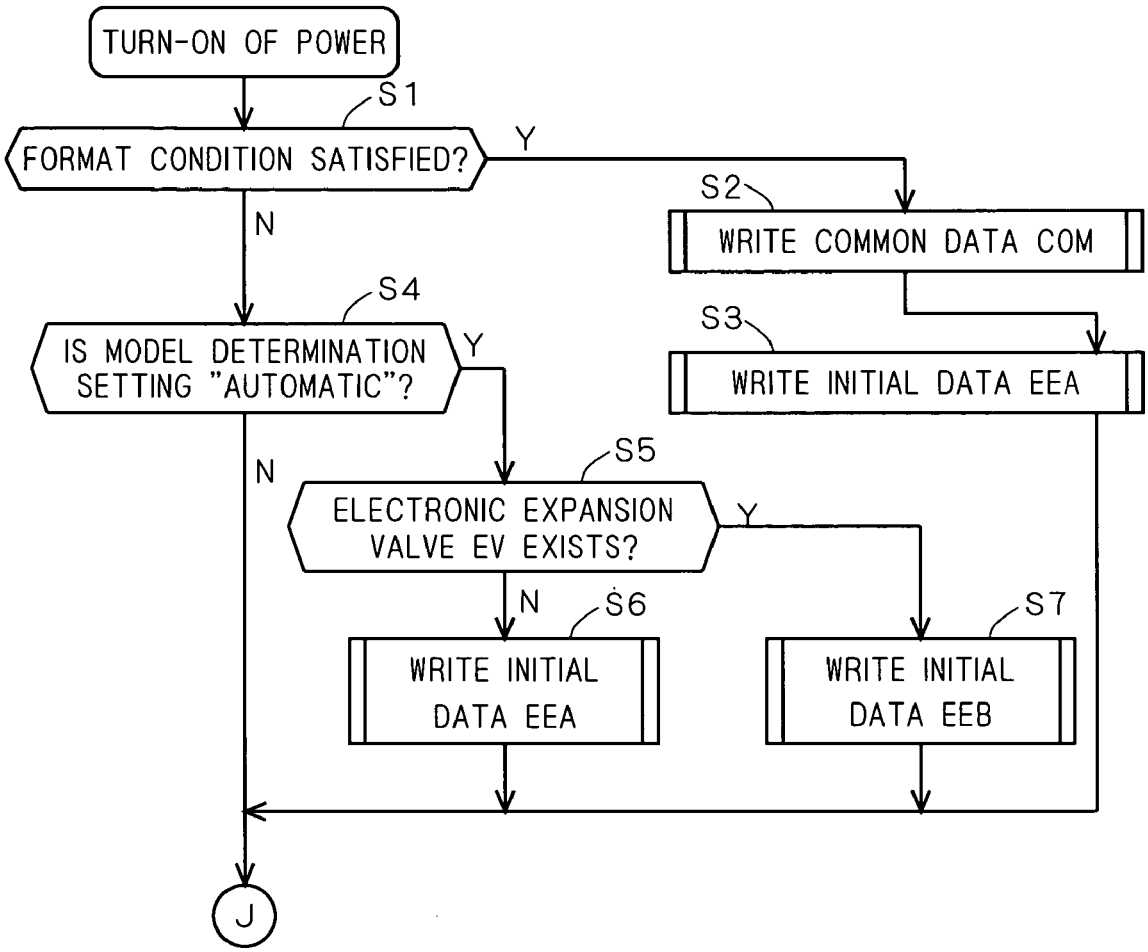
FIG. 6 is a flowchart showing the second embodiment of the present invention.
Figure 7:
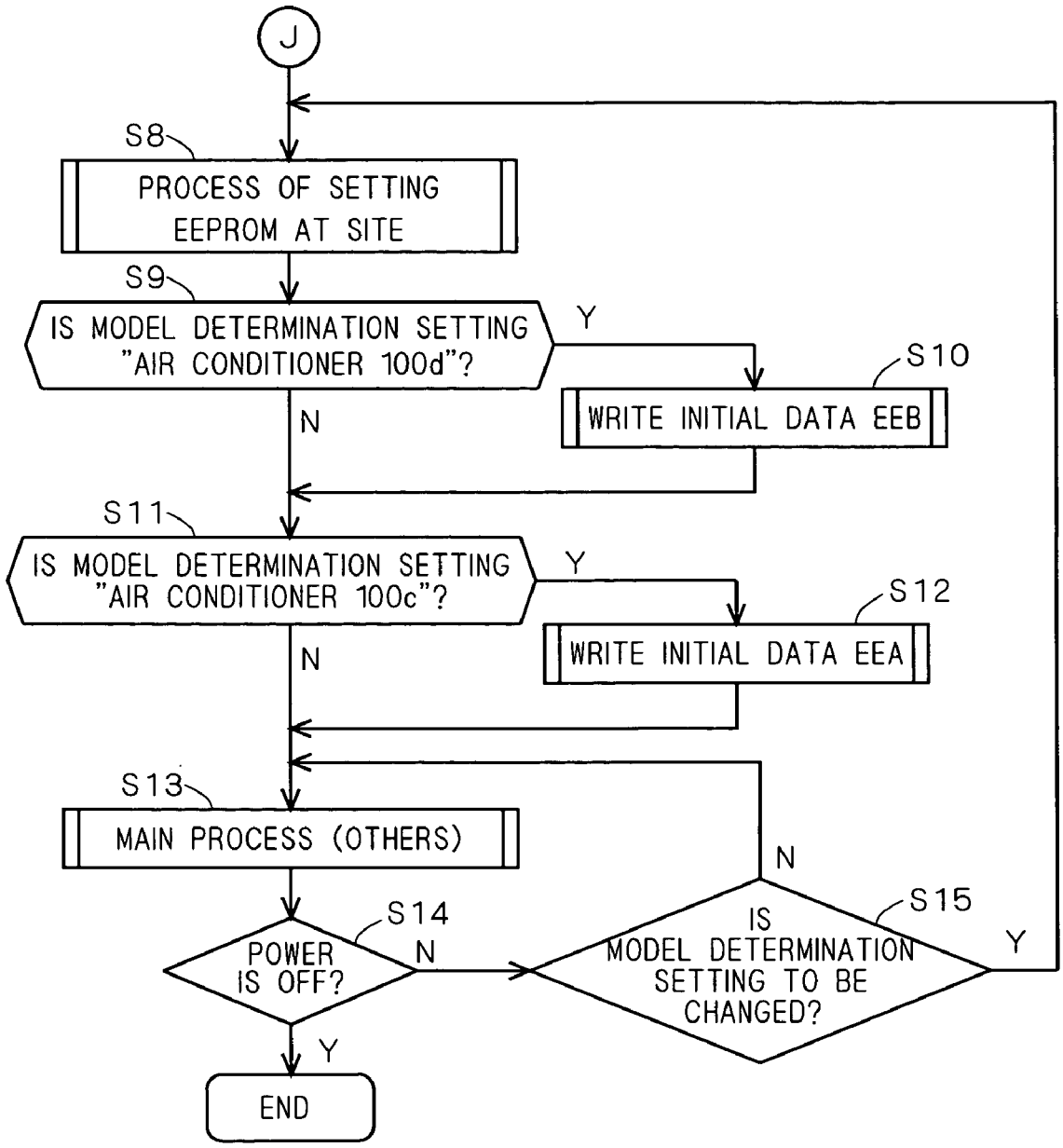
FIG. 7 is a flowchart showing the second embodiment of the present invention.

FIGS. 6 and 7 are flowcharts showing a data storing method according to the embodiment. The flowcharts shown in the diagrams can be connected to each other via a connector J or can function independently of each other.

When the power of the air conditioner 100*c* or 100*d* on which the electronic circuit 20 is mounted is turned on, the electronic circuit 20 is also turned on. In step S1, whether a condition of enabling formatting of the EEPROM 2 (format condition) is satisfied or not is determined. For example, immediately after manufacture, no data is written on the EEPROM 2 and the format condition is satisfied. In this case, the route indicated as "Y" in the diagram leading to step S2 is adopted and the common data COM is written from the ROM 1 to the EEPROM 2.

Figure 8:
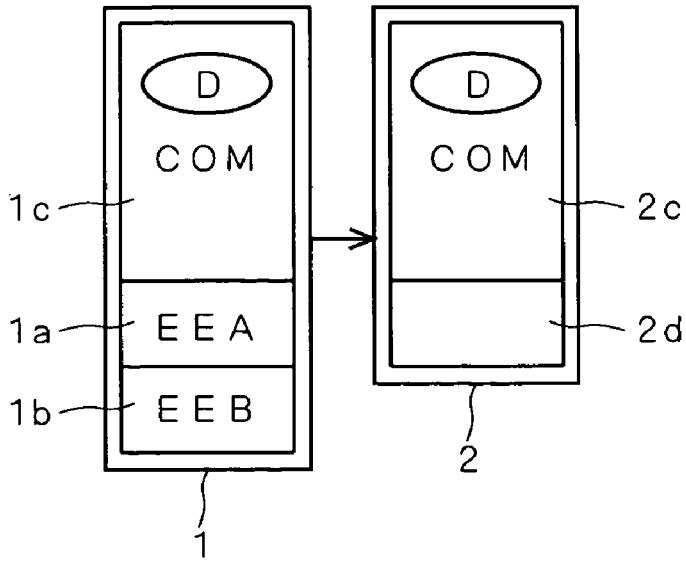
FIG. 8 is a schematic diagram showing the second embodiment of the present invention.

FIG. 8 is a schematic diagram showing a state where step S2 is executed. The ROM 1 has areas 1*a*, 1*b*, and 1*c* as memory spaces where the initial data EEA and EEB and the common data COM is stored. In step S2, the common data COM is written from the area 1*c* to the area 2*c* in the EEPROM 2. By setting the common data COM which is commonly used in both the air conditioner 100*c* having no electronic expansion valve and the air conditioner 100*d* having the electronic expansion valve, the amount of data to be stored in the ROM 1 can be reduced.

The common data COM includes determination mode data D indicative of a mode of determination on the model of the air conditioner in addition to the conventional technique. The determination mode data D stored in the area 2*c* in step S2 expresses that the mode of determination is "automatic".

Figure 9:
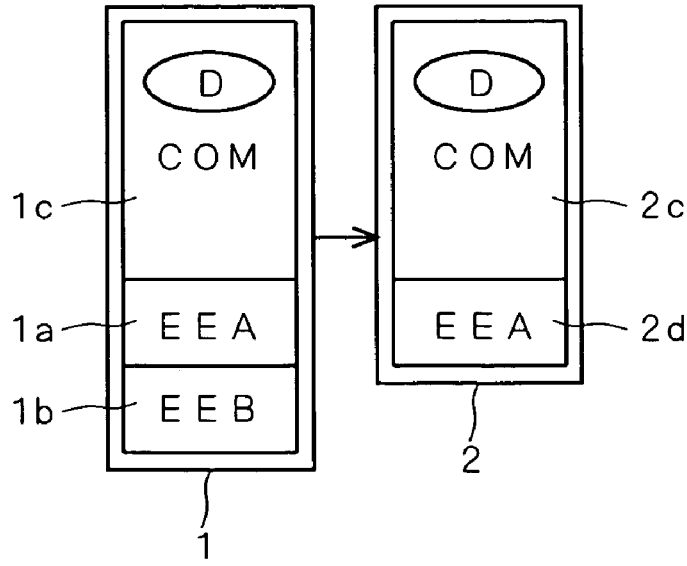
FIG. 9 is a schematic diagram showing the second embodiment of the present invention.

After execution of step S2, in step S3, the initial data EEA is written as a default from the ROM 1 to the EEPROM 2. FIG. 9 is a schematic diagram showing a state where step S3 is executed. The initial data EEA is written from the area 1*a* to the area 2*d* in the EEPROM 2.

Figure 10:
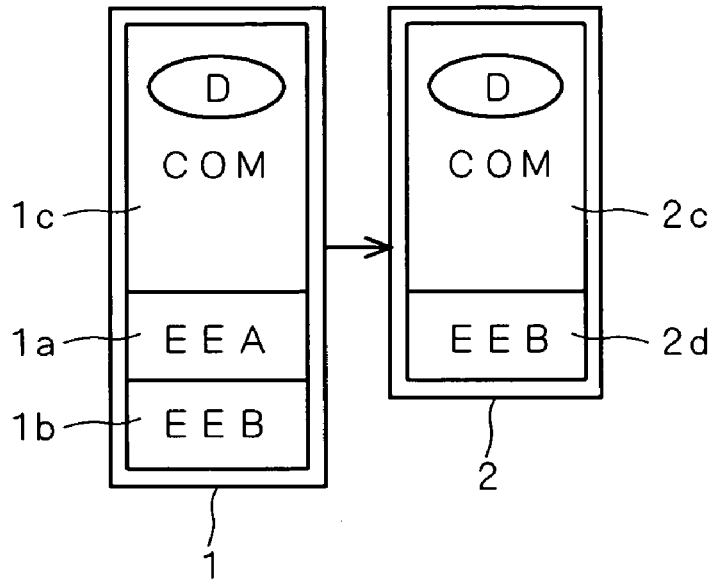
FIG. 10 is a schematic diagram showing the second embodiment of the present invention.
Figure 11:
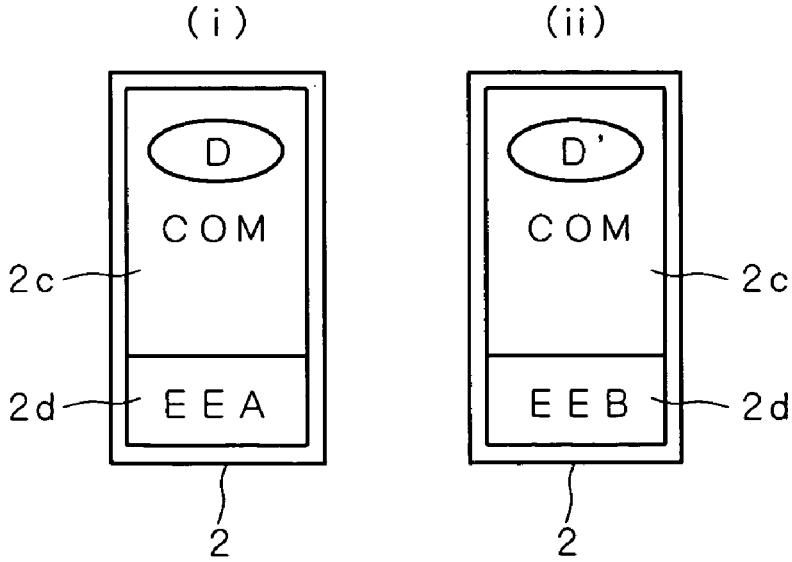
FIG. 11 is a schematic diagram showing the second embodiment of the present invention.
Figure 12:
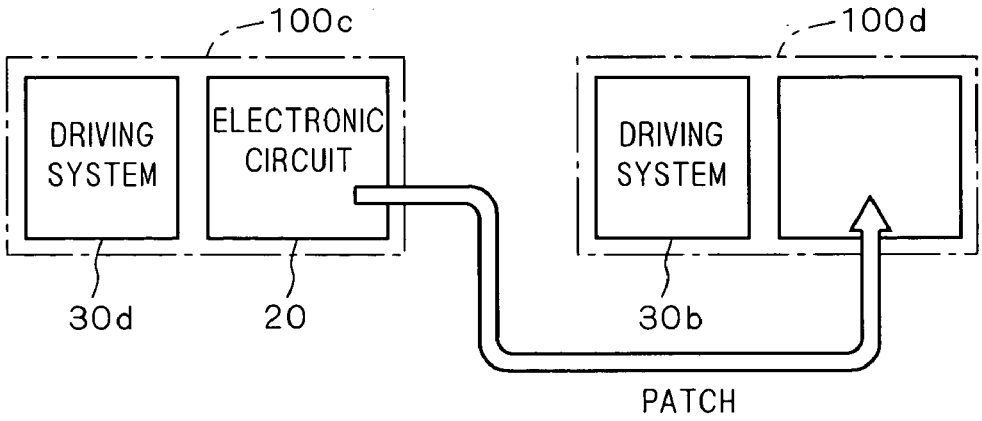
FIG. 12 is a schematic diagram showing effects of the second embodiment of the present invention.

Alternately, the initial data EEB may be written as a default from the ROM 1 to the EEPROM 2. In this case, as schematically shown in FIG. 10, the initial data EEB is written from the area 1*b* to the area 2*d*. By the operation, data to be stored in the EEPROM 2 is tentatively determined.

After step S3 is executed, the flow of the process reaches the connector J. After steps S1, S2, and S3 are executed, the electronic circuit 20 which is detached from the air conditioner 100*c* or 100*d* and on which the formatted EEPROM 2 is mounted can be shipped from the factory and distributed. To execute steps S1, S2, and S3 for shipment from the factory, it is unnecessary to mount the electronic circuit 20 on the air conditioner 100*c* or 100*d*. Power may be supplied to the electronic circuit 20 itself in a manufacturing line of manufacturing the electronic circuit 20.

In the manufacturing line of manufacturing the air conditioner 100*c* or 100*d*, assembly is performed by using the electronic circuit 20 subjected to steps S1, S2, and S3. By turning on the power of the air conditioner 100*c* or 100*d*, the electronic circuit 20 is also turned on. In the electronic circuit 20, the common data COM is already written in step S2. Therefore, it is unnecessary to format the electronic circuit 20 again and execute steps S2 and S3.

In order not to execute steps S2 and S3, in step S1, determination is made on the basis of the presence or absence of the common data COM. In such a manner, whether or not the EEPROM 2 in the electronic circuit 20 is the EEPROM 2 which has been already subjected to the steps S1, S2, and S3 can be determined.

When it is determined in step S1 that the format condition is not satisfied in the electronic circuit 20, via the route indicated as "N" in the diagram leading to step S4, it is determined whether the mode of determination with respect to the model of the air conditioner is "automatic" or not. For example, if the electronic circuit 20 is just shipped from a factory, the determination mode data D is included in the common data COM in step S2. Moreover, since the determination mode data D indicates that the mode of determination is "automatic", step S5 is reached via the route indicated as "Y" in the diagram. The case where negative determination is made in step S4 will be described later and the description will be postponed.

In step S5, whether the electronic expansion valve EV exists or not is determined by the determining unit 4 and the result of determination is transmitted to the CPU 3. When there is no electronic expansion valve EV, step S6 is reached via the route indicated as "N". In this case, the air conditioner 100*c* on which the electronic circuit 20 is mounted has the driving system 30*a*. Consequently, as shown in FIG. 9, the initial data EEA as data adapted to control on the driving system 30*a* is stored from the ROM 1 to the EEPROM 2. The operation can be performed under control of the CPU 3 which has obtained data indicative of the absence of the electronic expansion valve EV from the determining unit 4.

On the other hand, when there is the electronic expansion valve EV, step S7 is reached via the route indicated as "Y" in the diagram. In this case, since the air conditioner 100*d* on which the electronic circuit 20 is mounted has the driving system 30*b*, as shown in FIG. 40, the initial data EEB as data adapted to control on the driving system 30*b* is stored from the ROM 1 to the EEPROM 2. The operation can be performed under control of the CPU 3 which has obtained data indicative of the presence of the electronic expansion valve EV from the determining unit 4.

Each of the integrated circuit 10 having the EEPROM 2 subjected to step S6 or S7 and the electronic circuit 20 is set to be adapted to the air conditioner 100*c* or 100*d* on which it is mounted.

As described above, whether the electronic expansion valve EV exists or not is determined in step S5 and, by using the result of determination, the kind of the equipment is determined. On the basis of the result of determination, the initial data EEA or EEB is stored from the ROM 1 to the EEPROM 2 in step S6 or S7. The initial data EEA or EEB is alternatively and automatically stored. Before execution of step S4, the mode of determination is set to "automatic" in step S2 and data is alternatively and automatically stored in the EEPROM. The mode of determination can be set to "automatic" in step S8.

Moreover, whether the mode of determination is "automatic" or not is determined in step S4 by using the determination mode data D written in the EEPROM 2 in step S2. Consequently, it is easy to set the mode of automatically determining the model of an equipment.

After the flow of process reaches the connector J from step S4, S6, or S7, the air conditioner 100*c* or 100*d* is distributed for shipment from the factory, change in the installation place, or the like. It is desirable to re-set initial data at a site where the air conditioner 100*c* or 100*d* is installed.

When the power of the air conditioner 100*c* or 100*d* is turned on at the site, after the flowchart shown in FIG. 6 is executed, step S8 in FIG. 7 is reached via the connector J. In step S8, a process of setting the EEPROM 2 at the site is performed. By the process, the mode of determination is set as "automatic", or the air conditioner 100*c* on which the drive system 30*b* is mounted or the air conditioner 100*d* on which the driving system 30*b* is mounted is forcedly determined. Concretely, for example, the determination mode data D is rewritten and the CPU 3 operates on the basis of the rewritten determination mode data D, thereby forcedly determining the model of the device by ignoring the result of determination of the determining unit 4, and determining the kind of data to be stored in the area 2*d*.

Proceeding from step S8 to step S9 where the model determination setting is forcedly set as the air conditioner 100*d* or not is determined. For example, if the model determination setting is forcedly set as the air conditioner 100*d* in step S8, step S10 is reached via the route indicated as "Y" from step S9. The initial data EEB proper to the air conditioner 100*d* is written in the EEPROM 2.

FIG. 41 is a diagram schematically showing an example of the operation in step S10. FIG. 41(*i*) shows the state of the EEPROM 2 in which the initial data EEA is already written in the area 2*d* in step S3 or S6. FIG. 41(*ii*) shows a state where step S1 is executed on the EEPROM 2 in the state of FIG. 41(*i*) and the initial data EEB is written. In FIG. 41(*i*), the symbol D indicates that the determination mode data D written in step S2 remains and unchanged. In FIG. 41(*ii*), the symbol D' shows that the contents of the determination mode data D is changed from "automatic" to "air conditioner 100*d*" in step S8.

If it is determined in negative in step S9, step S11 is reached via the route indicated as "N" in the diagram from step S9. In step S11, whether the model determination setting is forcedly set as the air conditioner 100*c* or not is determined. For example, when the model determination is forcedly set as the air conditioner 100*c* in step S8, step S12 is reached from step S11 via the route indicated as "Y" in the diagram. Then, the initial data EEA proper to the air conditioner 100*c* is written in the EEPROM 2. If it is determined in negative in step S11, step S13 is reached from step S11 via the route indicated as "N" in the diagram.

As described above, by executing the flowchart shown in FIG. 7, the data in the EEPROM 2 once automatically set can be re-set manually. Thus, a change at the site where the air conditioner 100*c* or 100*d* is installed can be flexibly dealt with.

As obvious from the above process, the order of the pair of steps S9 and S10 and the pair of steps S11 and S12 can be exchanged.

In step S13, processes other than the initial setting of the EEPROM 2, for example, setting of the temperature of the air conditioner, setting of wind direction, and the like are performed. The amounts which are set in such a manner can be stored as user setting parameters in, for example, the area 2*d* in the EEPROM 2 in step S13.

After that, when it is determined in step S14 that the power source is off, via the route indicated as "Y" in the diagram, the flowchart is finished. If the power source is not off, step S15 is reached via the route indicated as "N" in the diagram.

In step S15, whether the model determination setting is changed or not is determined. In the case of making the change, step S8 is reached back via the route indicated as "Y" in the diagram. In the case where the model determination setting is not changed, step S13 is reached back.

As described above, after the power source is turned off, the setting at the site of the EEPROM 2 is also completed. However, there is also a case that the user desires to further change data stored in the EEPROM 2 at the site after the power source is turned off. FIG. 42 is a schematic diagram showing such a case. FIG. 42 shows a case that the electronic circuit 20 is once mounted on the air conditioner 100*c* and, after that, is used as a patch in the air conditioner 100*d*. In such a case, step S7 or S10 has to be executed again.

Also in the case where the electronic circuit 20 having the EEPROM 2 which is once mounted on the air conditioner 100*c* and is properly set is used as a patch for the air conditioner 100*d* and the power source is turned on, the flowcharts of FIGS. 6 and 7 can be employed. First, in step S1, since the EEPROM 2 is already set for the air conditioner 100*c*, determination is made in negative and the program advances to step S4.

If step S12 is executed when the EEPROM 2 is mounted on the air conditioner 100*c* and is set, determination is made in negative also in step S4 and the connector J is reached (this case corresponds to the case of which description has been postponed). The program advances to step S8 via the connector J and the model determination setting is forcedly set as the air conditioner 10*d*. Step S10 is reached via step S9 and the initial data EEB is written.

On the other hand, if step S6 is executed and step S12 is not executed after that when the EEPROM 2 is mounted on the air conditioner 100*c* and is set, positive determination is made in step S4. This corresponds to the case where, for example, after step S6 is executed, the determination mode data D is left as "automatic" in step S8. Step S7 is reached via step S5 and the initial data EEB is written.

Alternately, the flowcharts of FIGS. 6 and 7 can be employed also in the case where the electronic circuit 20 is shipped from a factory and is singly employed as a patch part at a site for the following reason. By executing step S3, the EEPROM 2 of the electronic circuit 20 is set adapted to the air conditioner 100*c* at the time of shipment from the factory.

When the mode of determination is "automatic", an object of which presence or absence is determined by the determining unit 4 in step S5 does not have to be limited to the electronic expansion valve EV. Obviously, the object may be other parts and it is easy to realize the present invention with the other parts. The present invention can be, obviously, applied to an equipment other than the air conditioner.

While the invention has been shown and described in detail, the foregoing description is in all aspects illustrative and not restrictive. It is therefore understood that numerous modifications and variations can be devised without departing from the scope of the invention.

The invention claimed is:

1. A function switching method of controlling a device in which a first function which requires an operation of a first part and a second function which does not require said operation of said first part are switched depending on presence/absence of a second part, comprising steps of:

(a) determining said presence/absence of said second part; and (b) determining whether said operation of said first part can be performed or not on the basis of a result of said step (a), wherein the second part is remote-controlled by a communication function from outside the device.

2. A function switching method of controlling a device in which a first function which requires an operation of a first part and a second function which does not require said operation of said first part are switched depending on presence/absence of a second part, comprising steps of:

(a) determining said presence/absence of said second part; and (b) determining whether said operation of said first part can be performed or not on the basis of a result of said step (a), wherein said first part operates on the basis of a clock.

3. A function switching device comprising a processor and a first part, wherein said processor determines whether an operation of said first part can be performed or not depending on presence/absence of a second part on outside of said device, thereby instructing said outside of said device to be switched between a first function which requires said operation of said first part and a second function which does not require said operation of said first part, wherein the second part is remote-controlled by a communication function from outside the device.

4. A function switching device comprising a processor and a first part, wherein said processor determines whether an operation of said first part can be performed or not depending on presence/absence of a second part on outside of said device, thereby instructing said outside of said device to be switched between a first function which requires said operation of said first part and a second function which does not require said operation of said first part, and said first part operates on the basis of a clock.

5. The function switching device according to claim 4, further comprising:

determining means for determining said presence/absence of said second part and transmitting a result thereof to said processor.

6. The function switching device according to claim 5, wherein said first part has a communicating function.

7. An air conditioner including a function switching device according to claim 6, wherein said second part is an electronic expansion valve.

* * * * *

UNITED STATES PATENT AND TRADEMARK OFFICE

CERTIFICATE OF CORRECTION

PATENT NO. : 7,257,954 B2
APPLICATION NO. : 10/489178
DATED : August 21, 2007
INVENTOR(S) : Toshinori Ushio et al.

It is certified that error appears in the above-identified patent and that said Letters Patent is hereby corrected as shown below:

At the Title Page, column 54, title replace

"FUNCTION SWITCHING METHOD, FUNCTION SWITCHING APPARATUS, DATA STORAGE METHOD, DATA STORAGE APPARATUS, DEVICE, AND AIR CONDITIONER" with --FUNCTION SWITCHING METHOD AND FUNCTION SWITCHING DEVICE, DATA STORING METHOD AND DATA STORING DEVICE, AS WELL AS EQUIPMENT AND AIR CONDITIONER--

Signed and Sealed this

Fifteenth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,257,954 B2
APPLICATION NO. : 10/489178
DATED : August 21, 2007
INVENTOR(S) : Toshinori Ushio et al.

It is certified that error appears in the above-identified patent and that said Letters Patent is hereby corrected as shown below:

At the Title Page, Item 54 and Column 1, lines 1-5, title replace

"FUNCTION SWITCHING METHOD, FUNCTION SWITCHING APPARATUS, DATA STORAGE METHOD, DATA STORAGE APPARATUS, DEVICE, AND AIR CONDITIONER" with --FUNCTION SWITCHING METHOD AND FUNCTION SWITCHING DEVICE, DATA STORING METHOD AND DATA STORING DEVICE, AS WELL AS EQUIPMENT AND AIR CONDITIONER--

This certificate supersedes the Certificate of Correction issued April 15, 2008.

Signed and Sealed this

Sixth Day of May, 2008

JON W. DUDAS
*Director of the United States Patent and Trademark Office*